US008746825B2

(12) United States Patent
Wakai

(10) Patent No.: US 8,746,825 B2
(45) Date of Patent: Jun. 10, 2014

(54) PRINTING SYSTEM, CONTROL METHOD OF PRINTING SYSTEM, AND STORAGE MEDIUM

(75) Inventor: Kazuo Wakai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 99 days.

(21) Appl. No.: 13/597,033

(22) Filed: Aug. 28, 2012

(65) Prior Publication Data

US 2013/0057607 A1 Mar. 7, 2013

(30) Foreign Application Priority Data

Sep. 1, 2011 (JP) ..... 2011-190737

(51) Int. Cl.
*B41J 29/38* (2006.01)

(52) U.S. Cl.
USPC ..... 347/9; 347/16; 347/101

(58) Field of Classification Search
USPC ..... 347/5, 9, 14, 16, 101, 104–107
See application file for complete search history.

(56) References Cited

U.S. PATENT DOCUMENTS 5,774,759 A * 6/1998 Tanaka ..... 399/8
2009/0261524 A1* 10/2009 Nakayama et al. ..... 271/3.14

FOREIGN PATENT DOCUMENTS

JP 2006-62772 A 3/2006
JP 2009-256077 A 11/2009

* cited by examiner

*Primary Examiner* — Juanita D Jackson
(74) *Attorney, Agent, or Firm* — Canon U.S.A., Inc., IP Division

(57) ABSTRACT

When printing is to be performed on sheets by switching a plurality of sheet storage units and feeding the sheets, a user confirms, before the designated number of sheets is printed, whether the sheet matches a designated sheet type, and then instructs printing to be continued. Two or more sheet storage units among the plurality of sheet storage units are set as one group, and one sheet is conveyed from each of the two or more sheet storage units set as one group. An image is printed on the conveyed sheets which are then discharged to a sheet discharge unit, and printing is interrupted. If an instruction to continue the interrupted printing is received, control is performed to resume the interrupted printing.

7 Claims, 19 Drawing Sheets

FIG.5

GROUPED SHEET FEEDING DEVICE INFORMATION TABLE

| GROUP NUMBER | GROUPED SHEET FEEDING DEVICES | NUMBER OF GROUPED SHEET FEEDING DEVICES (A) |
|---|---|---|
| 1 | 105, 106 | 2 |
| 2 | 120, 121 | 2 |
| 3 | 122 | 1 |

FIG.16

SHEET FEEDING DEVICE INFORMATION TABLE

| SHEET FEEDING DEVICE NUMBER | CORRESPONDING SHEET FEEDING DEVICE |
|---|---|
| 1 | 105 |
| 2 | 106 |
| 3 | 120 |
| 4 | 121 |
| 5 | 122 |

PRINTING SYSTEM, CONTROL METHOD OF PRINTING SYSTEM, AND STORAGE MEDIUM

BACKGROUND OF THE INVENTION

1. Field of the Invention

The present invention relates to a printing system, a control method of a printing system, and a storage medium.

2. Description of the Related Art

There is a technique in which a printing apparatus including a plurality of sheet feeding devices (i.e., sheet feed stages) groups the plurality of sheet feeding devices (refer to Japanese Patent Application Laid-Open No. 2009-256077). If a print job designating a specific sheet feeding device is then input to the printing apparatus, any sheet feeding device belonging to the group becomes usable. As a result, the grouped sheet feeding devices are treated as one sheet feeding device, so that a sheet run-out is reduced.

When such a plurality of sheet feeding devices is treated as one group, and a user replenishes the sheets in a sheet feeding device of the group, the user may replenish an incorrect type of sheet. The printing apparatus may thus print on the incorrect sheets.

To prevent such a problem, there is a technique in which, when a print job is input, the printing apparatus feeds the sheets from each sheet feeding device, and then uses a sensor to detect characteristics (e.g., size, color, and grammage) of the sheets (refer to Japanese Patent Application Laid-Open No. 2006-62772).

According to the above-described technique, when the sheet feeding devices are grouped, it is necessary for the grouped sheet feeding devices to have the same settings and to contain the same sheets, so that a user interface (UI) in the printing apparatus is used to prevent an error in the settings and the type of sheets. However, if the user actually replenishes an incorrect type of sheet, the user cannot notice such a state until printing has ended. The user thus cannot recognize the error and stop printing at an initial stage of printing, so that the sheets are unnecessarily consumed.

SUMMARY OF THE INVENTION

According to an aspect of the present invention, a printing system which conveys a sheet from one of a plurality of sheet storage units and prints an image on a conveyed sheet includes a setting unit configured to set two or more sheet storage units among a plurality of sheet storage units as one group, a printing unit configured to convey one sheet from each of the two or more sheet storage units set as one group, print an image on the conveyed sheets, discharge the sheets to a sheet discharge unit, and interrupt printing, a receiving unit configured to receive an instruction to continue the interrupted printing, and a control unit configured to perform, in a case where the receiving unit receives the instruction, control to resume the interrupted printing.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 5 illustrates a grouped sheet feeding device information table managed in the printing apparatus.

FIG. 16 illustrates an example of the UI displayed on the operation unit illustrated in FIG. 3.

DESCRIPTION OF THE EMBODIMENTS

Various exemplary embodiments, features, and aspects of the invention will be described in detail below with reference to the drawings.

System Configuration

Figure 1:
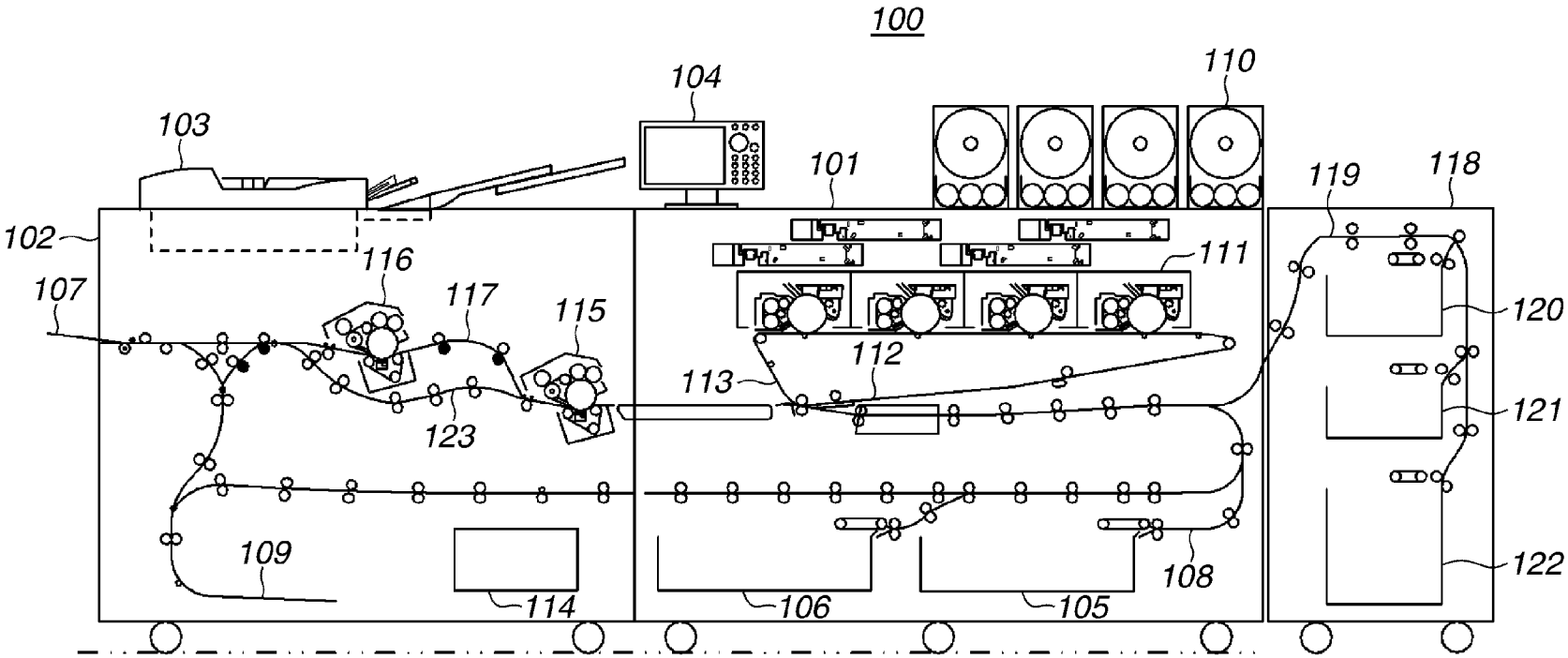
FIG. 1 is a cross-sectional view illustrating a configuration example of a printing apparatus according to an exemplary embodiment of the present invention.

FIG. 1 is a cross-sectional view illustrating a configuration example of the printing apparatus according to a first exemplary embodiment of the present invention. A printing apparatus 100 including a plurality of sheet feeding units to be grouped and managed, and connectable to a post-processing unit will be described below as an example of the printing apparatus (or a printing system).

Referring to FIG. 1, the printing apparatus 100 includes an image forming unit 101, a fixing portion 102, a scanner unit 103, an operation unit 104, a sheet discharge unit 107, a toner replenishing unit 110, and an external sheet feeding apparatus 118. The image forming unit 101 includes sheet feeding devices 105 and 106, a conveyance unit 108, a primary transfer unit 111, a transfer belt 112, and a secondary transfer unit 113. The fixing portion 102 includes a switch back unit 109, a waste toner containing unit 114, fixing units 115 and 116, and conveyance units 117 and 123. The external sheet feeding apparatus 118 includes a conveyance unit 119, and sheet feeding devices 120, 121, and 122.

The scanner unit 103 scans a document and generates electronic data of the image. The operation unit 104 receives from an operator various instructions with respect to the printing apparatus 100. Further, the operation unit 104 includes hard keys and a display unit such as a touch panel. The sheet feeding devices 105, 106, 120, 121, and 122 contain the sheets on which the printing apparatus 100 performs printing. The sheet discharge unit 107 discharges the printed sheets outside the printing apparatus 100. Each conveyance unit includes rollers for conveying the sheets at constant intervals. The switch back unit 109 reverses, when discharging the sheet to the sheet discharge unit 107, a printing side of the sheet. The toner replenishing unit 110 replenishes the toner, i.e., a developer, in the image forming unit 101. The primary transfer unit 111 transfers to the transfer belt 112 a toner image formed according to the image data.

The secondary transfer unit 113 transfers to the sheet the toner image transferred to the transfer belt 112. The waste toner containing unit 114 contains excessive toner generated in a transfer process. The fixing unit 115 applies heat and pressing force on the sheet to which the secondary transfer unit 113 has transferred the image, and fixes the toner on the sheet. The fixing unit 116 then further applies heat and pressing force on the sheet on which the fixing unit 115 has fixed the image, and reinforces fixing of the image.

The conveyance units 108, 117, 119, and 123 are conveyance paths for conveying the sheet. The conveyance unit 117 is the conveyance path for conveying the sheet from the fixing unit 115 to the fixing unit 116. The conveyance unit 123 is the conveyance path for conveying the sheet from the fixing unit 115 to the sheet discharge unit 107 or the switch back unit 109, without conveying the sheet via the fixing unit 116. The conveyance paths 108 and 119 are paths for conveying the sheet to the printing apparatus 100.

Configuration of a Sheet Discharge Device 200

Figure 2:
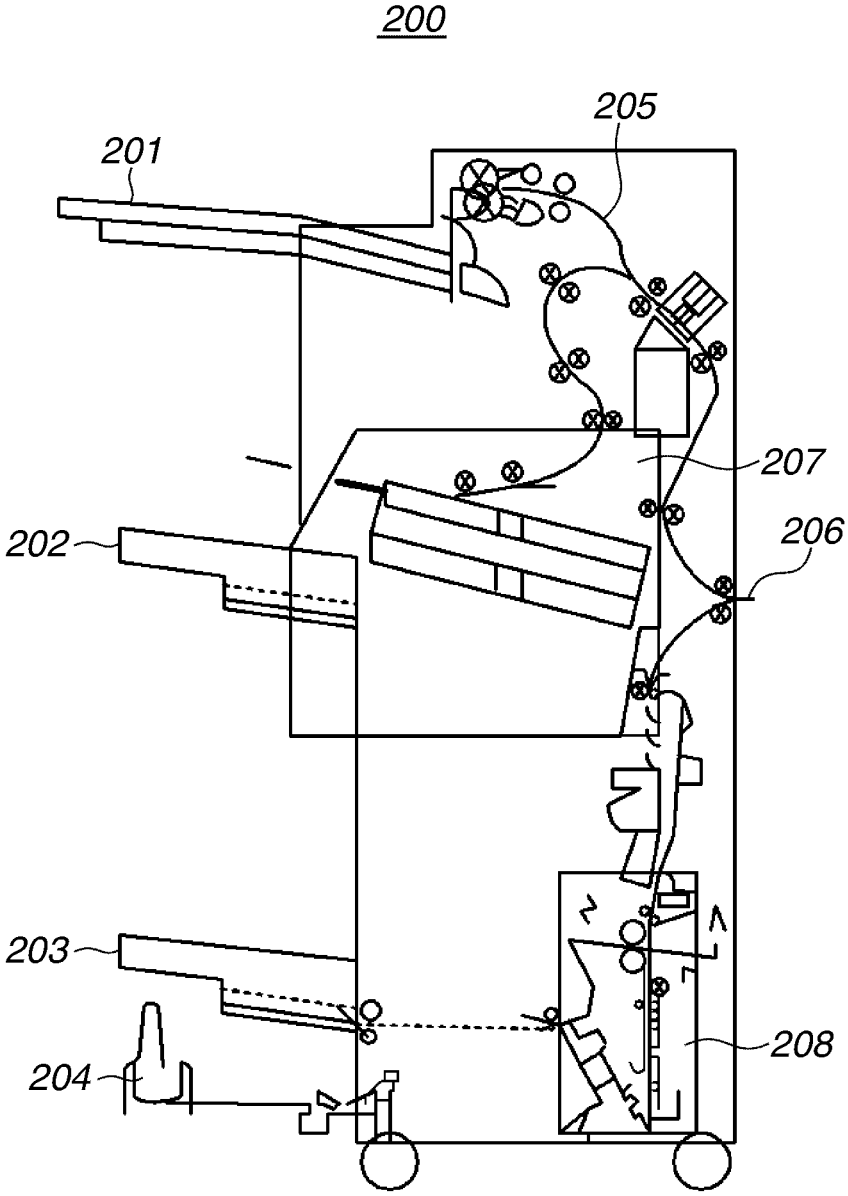
FIG. 2 is a cross-sectional view illustrating a sheet discharge device in the printing apparatus illustrated in FIG. 1.

FIG. 2 is a cross-sectional view illustrating a sheet discharge device 200 of the printing apparatus 100 illustrated in FIG. 2.

Referring to FIG. 2, a sheet input unit 206 receives the sheets via the sheet discharge unit 107. A conveyance path 205 is a path and a mechanism for conveying the sheet to each unit in the sheet discharge device 200. Discharge trays 201, 202, 203, and 204 are trays for stacking the discharged sheets. A different finishing functions (e.g., stapling, sorting, saddle stitch bookbinding, folding, and punching) corresponding to each discharge tray are provided, according to a route of the conveyance path 205 connected to the discharge tray. In particular, the discharge tray 201 is a stacking unit which supports none of the finishing functions.

A discharging option mechanism unit 207 includes the mechanisms for performing stapling and sorting. A folding mechanism unit 208 includes the mechanism for folding the sheets.

Control Configuration of the Printing Apparatus 100

Figure 3:
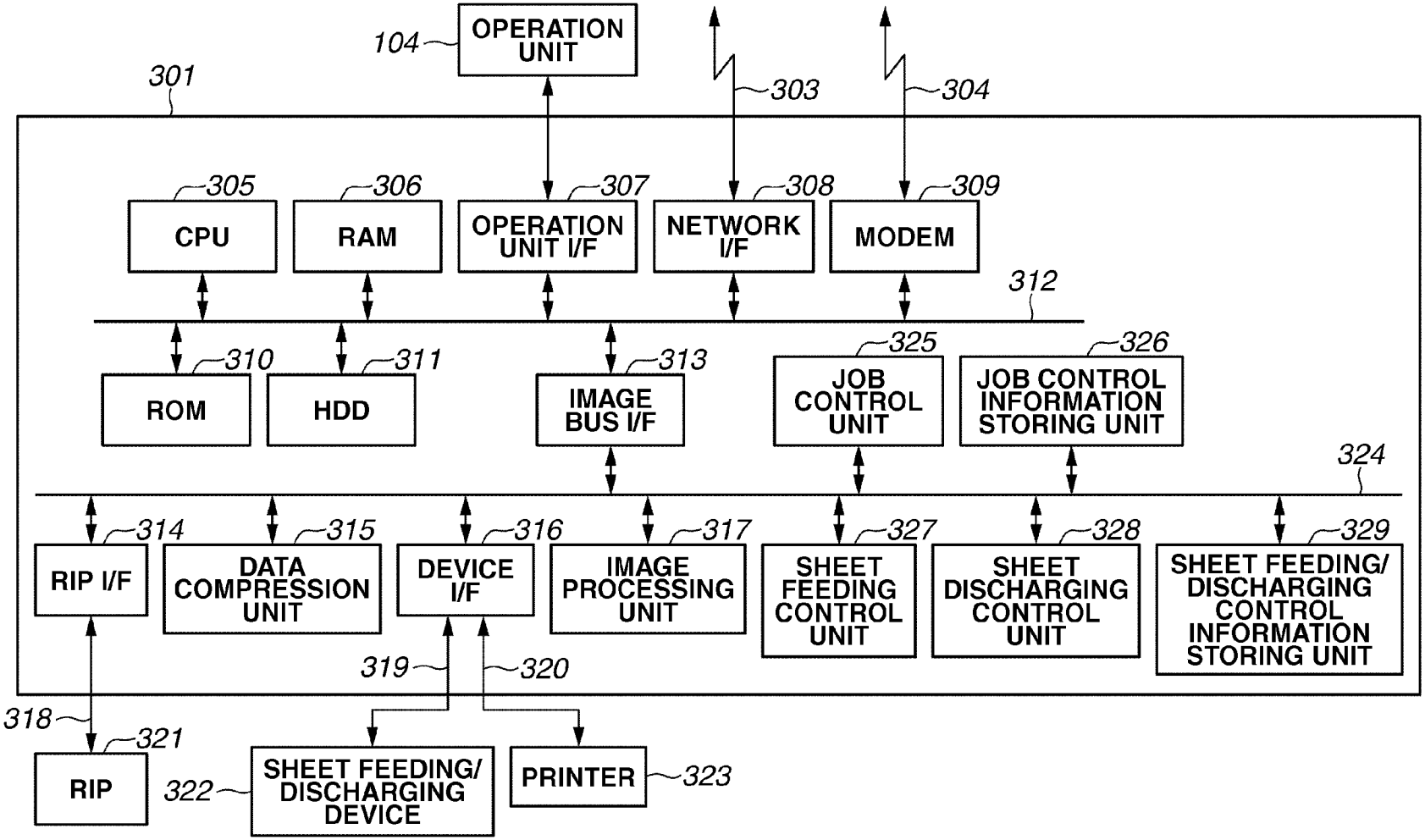
FIG. 3 is a block diagram illustrating a main controller in the printing apparatus.

FIG. 3 is a block diagram illustrating a main controller 301 in the printing apparatus 100 illustrated in FIG. 1.

Referring to FIG. 3, the main controller 301 includes a central processing unit (CPU) 305, a random access memory (RAM) 306, an operation unit interface (I/F) 307, a network I/F control unit 308, a modem 309, a read-only memory (ROM) 310, and a hard disk (HDD) 311. Further, the main controller includes via an image bus I/F 313, a raster image processor (RIP) I/F 314, a data compression unit 315, a device I/F 316, and an image processing unit 317. Furthermore, the main controller 301 includes a CPU bus 312 and an image bus 324.

The network I/F 308 is connected to a network cable 303 for connecting to external devices via a network. The modem 309 is connected to a communication cable 304 for connecting to the external devices via a phone line.

The CPU 305 executes programs for collectively controlling the main controller 301. The RAM 306 is managed by the programs running on the CPU 305. The RAM 306 is used as a receiving buffer for temporarily storing the data received from the outside, and an image buffer for temporarily storing the image data rasterized by a RIP 321. The ROM 310 stores the programs to be executed by the CPU 305 and the data. The HDD 311 is a non-volatile storage device capable of storing various data for a long period.

The operation unit I/F 307 is an interface which connects the operation unit 104 and the main controller 301. The image bus I/F 313 connects the CPU bus 312 and the image bus 324. The RIP I/F 314 is connected to the RIP 321 via a data bus 318. The RIP 321 is a rasterize board (RIP) including a function of converting to bitmap image data, image description data input from the outside. The RIP I/F 314 connects the RIP 321 and the image bus 324 using the data bus 318. The data compression unit 315 compresses the data.

The device I/F 316 is connected to a sheet feeding/discharging device 322 via a data bus 319, and to a printer 323 via a data bus 320. The configuration of the printer 323 is similar to the configuration described above with reference to FIG. 1.

The CPU 305 issues to the printer 323 and the sheet feeding/discharging device 322 via the data buses 319 and 320, a command for performing printing, according to a signal received from the operation unit 104 or the external device via the network cable 303. The image processing unit 317 performs various types of image processing on the bitmap image data generated by the RIP 321. The image processing unit 317 includes the function of digitally processing the bitmap image data, such as combining the bitmap image data of two pages into the bitmap image data of one page.

A job control unit 325 analyzes the data received from the outside as a job, and acquires control information such as a number of copies (N), a sheet feed designation, and sheet discharge processing information (e.g., stapling and discharging destination).

A job control information storing unit 326 is an area for storing the acquired control information. A sheet feeding control unit 327 manages, along with the CPU 305 and the job control unit 325, control of a sheet feeding process. A sheet discharging control unit 328 manages, along with the CPU 305 and the job control unit 325, a sheet discharging process. A sheet feeding/discharging control information storing unit 329 is an area for storing the control information necessary to manage the sheet feeding control unit 327 and the sheet discharging control unit 328.

Grouping of the Sheet Feeding Devices

According to the present exemplary embodiment, the grouping of the sheet feeding devices refers to virtually treating a plurality of sheet feeding devices as one group. Normally, if the sheet feeding device designated in the print job run out of sheets, the printing apparatus 100 stops printing. The operation unit 104 then displays a message prompting the user to replenish the sheets in the designated sheet feeding device. On the other hand, if the sheet feeding devices are grouped, and the sheets in the designated sheet feeding device run out, the printing apparatus 100 continues printing in the case where there are printable sheets in the sheet feeding device belonging to the same group.

Figure 4:
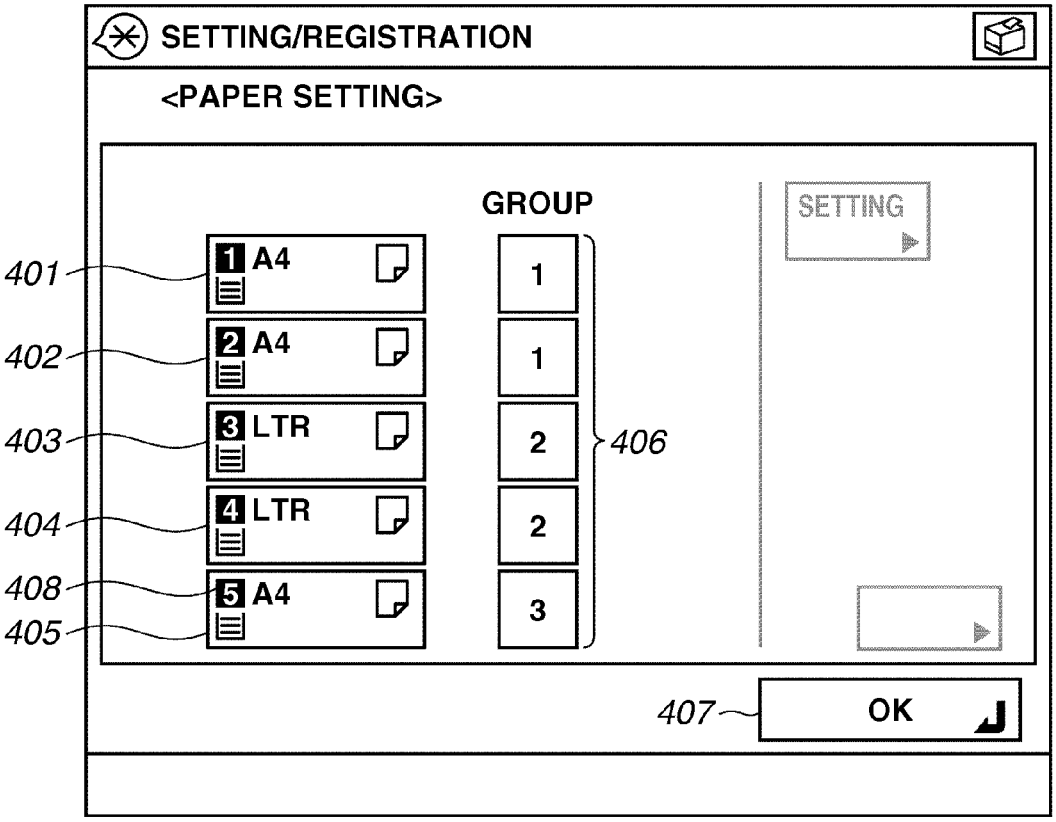
FIG. 4 illustrates an example of the UI displayed on an operation unit illustrated in FIG. 3.

FIG. 4 illustrates an example of the UI displayed on the operation unit 104 illustrated in FIG. 3, i.e., a setting screen for grouping the sheet feeding devices. A setting process for grouping sheet storage units (i.e., the sheet feeding devices) selected from a plurality of sheet storage units will be described below.

Referring to FIG. 4, icons 401, 402, 403, 404, and 405 respectively indicate the information on the sheet feeding devices 105, 106, 120, 121, and 122 illustrated in FIG. 1. Numbers 408 included in each of the icons 401, 402, 403, 404, and 405 are for identifying each sheet feeding device. Group setting buttons 406 indicate the groups to which each sheet feeding devices belong. According to the example illustrated in FIG. 4, the sheet feeding device 401 and the sheet feeding device 402 belong to group 1, the sheet feeding device 403 and the sheet feeding device 404 to group 2, and the sheet feeding device 405 to group 3. When the user presses the group setting button 406, the group number is incremented by one. The group number is changeable until the group number reaches the same number as the number of sheet feeding devices. If the group number reaches the number of sheet feeding devices, and the user presses the group setting button 406, the group number returns to "1".

If the user then presses an OK button 407 in the screen, the CPU 305 stores the current group setting in a grouped sheet feeding device information table illustrated in FIG. 5 in the sheet feeding control unit 328. According to the present exemplary embodiment, the grouped sheet feeding device information table is stored in the HDD 311. However, the grouped sheet feeding device information table may be stored in other non-volatile memory, such as a non-volatile RAM (NVRAM).

FIG. 5 illustrates an example of the grouped sheet feeding device information table managed in the HDD 311 illustrated in FIG. 3. Referring to FIG. 5, the grouped sheet feeding device information table illustrated in the present exemplary embodiment stores the information on the grouped sheet feeding devices and the number of the grouped sheet feeding devices (A) for each group number.

Figure 6:
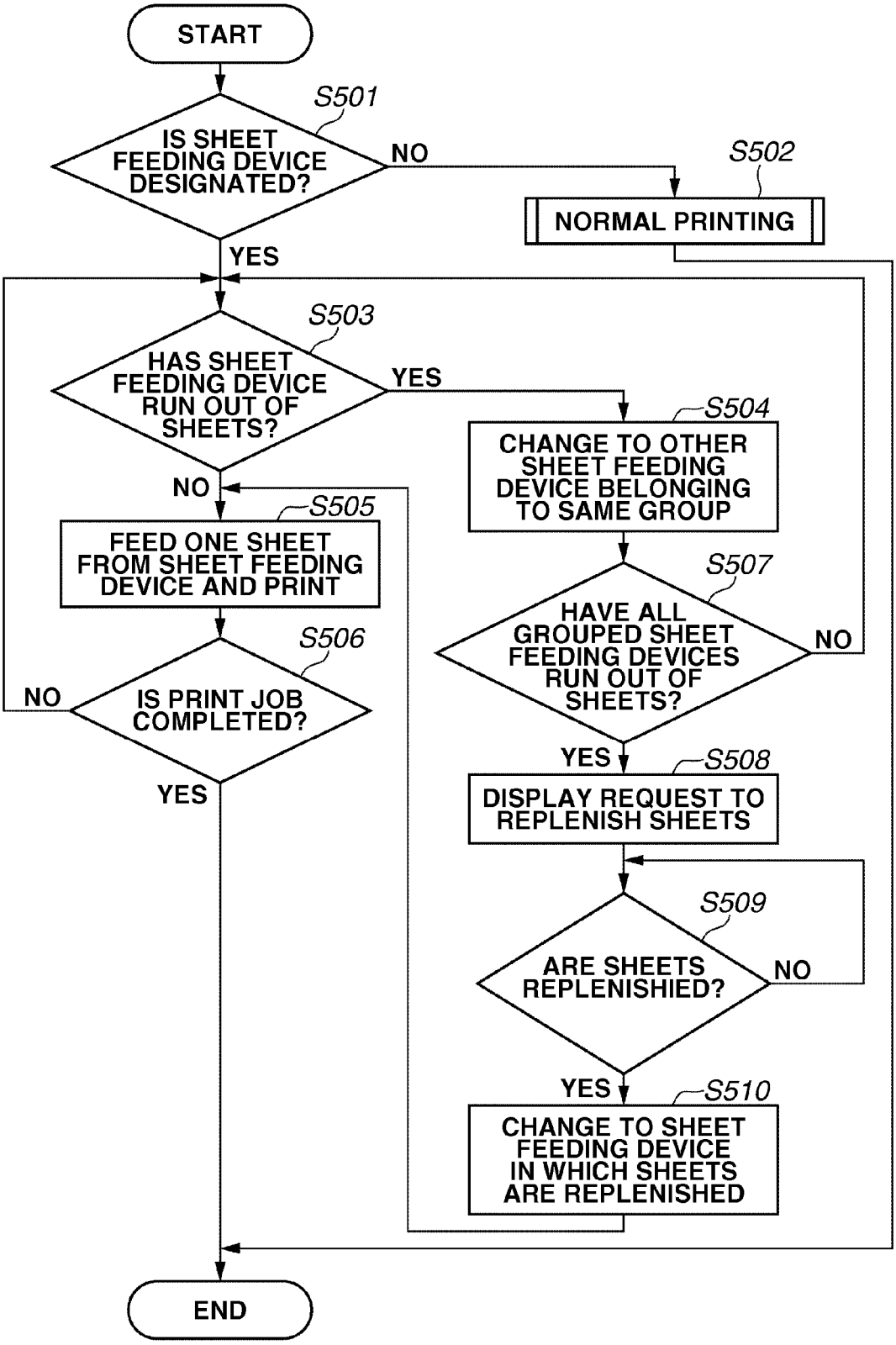
FIG. 6 is a flowchart illustrating a control method of the printing apparatus.

FIG. 6 is a flowchart illustrating a control method of the printing apparatus according to the present exemplary embodiment, i.e., an example of a process in which printing is performed using the grouped sheet feeding devices. Each step is realized by the CPU 305 loading in the RAM 306 the control programs stored in the ROM 310 and the HDD 311 and executing the programs.

In step S501, upon receiving the print job from an information processing apparatus via the network, the CPU 305 determines whether the sheet feeding device is designated in the print job. If the sheet feeding device is not designated (NO in step S501), the process proceeds to step S502. In step S502, the CPU 305 performs normal printing. The description on a normal printing process will be omitted. If the sheet feeding device is designated (YES in step S501), the process proceeds to step S503.

In step S503, the CPU 305 determines using the sensor (not illustrated) whether the sheets in the designated sheet feeding device have run out. If the sheets have run out (YES in step S503), the process proceeds to step S504. If the sheets have not run out (NO in step S503), the process proceeds to step S505.

In step S505, the printing apparatus 100 prints on one sheet fed from the sheet feeding device. In step S506, the CPU 305 determines whether the print job has been completed. If the print job has been completed (YES in step S506), the process ends. On the other hand, if the print job is not completed (NO in step S506), the process returns to step S503.

On the other hand, in step S504, the CPU 305 changes the sheet feeding device to be used to another sheet feeding device that belongs to the same group as the sheet feeding device in which the sheets have run out. In step S507, the CPU 305 determines whether the sheets in all sheet feeding devices belonging to the same group have run out. If there are sheets that can be used (NO in step S507), the process returns to step S503.

If the sheets in all sheet feeding devices belonging to the same group have run out (YES in step S507), the process proceeds to step S508. In step S508, the CPU 305 instructs the operation unit 104 via the operation unit I/F 307 to display a screen for prompting replenishment of the sheets. The operation unit 104 thus displays the screen for prompting replenishment of the sheets.

In step S509, the CPU 305 determines whether the user has replenished the displayed sheet feeding device which has run out of the sheets. If the user has replenished the sheet feeding device (YES in step S509), the process proceeds to step S510. If the user has not replenished the sheet feeding device (NO in step S509), the CPU 305 waits until the user replenishes the sheet feeding device.

In step S510, the CPU 305 changes the sheet feeding device to be used to the sheet feeding device in which the user has replenished the sheets. The process then returns to step S505. As described above, the sheet feeding devices are grouped, and printing is performed from the grouped sheet feeding device.

Test Printing

According to the present exemplary embodiment, when a plurality of copies is set to be printed in the print job, test printing is performed by printing only one copy, instead of printing all copies at once. The user then confirms the result of performing test printing, and if the result is satisfactory, the printing apparatus receives a user instruction to continue printing and prints the remaining copies.

Figure 7:
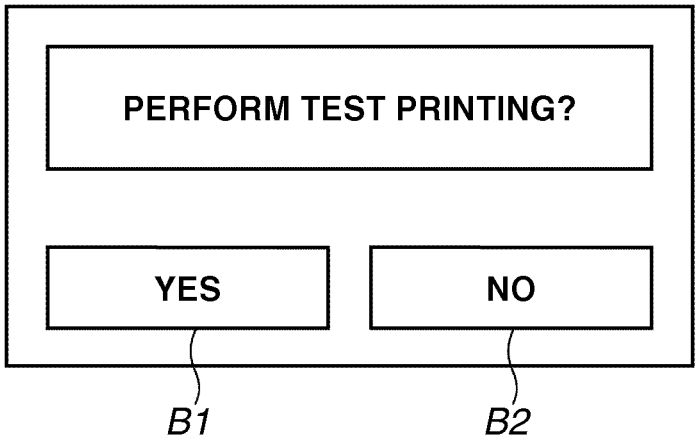
FIG. 7 illustrates an example of the UI displayed on the operation unit illustrated in FIG. 3.
Figure 8:
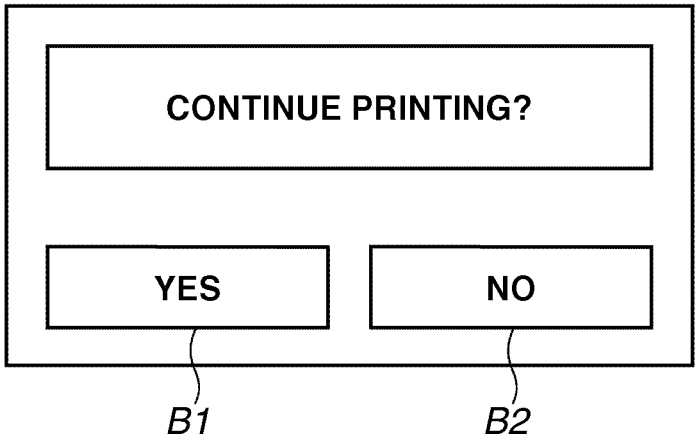
FIG. 8 illustrates an example of the UI displayed on the operation unit illustrated in FIG. 3.

FIGS. 7 and 8 illustrate examples of the UI displayed on the operation unit 104 illustrated in FIG. 3, i.e., examples of a test printing instruction screen. FIG. 7 illustrates the screen for inquiring the user on whether to start test printing, and FIG. 8 illustrates the screen for inquiring, when test printing has ended, whether to continue printing the remaining number of copies set in the print job.

Figure 9:
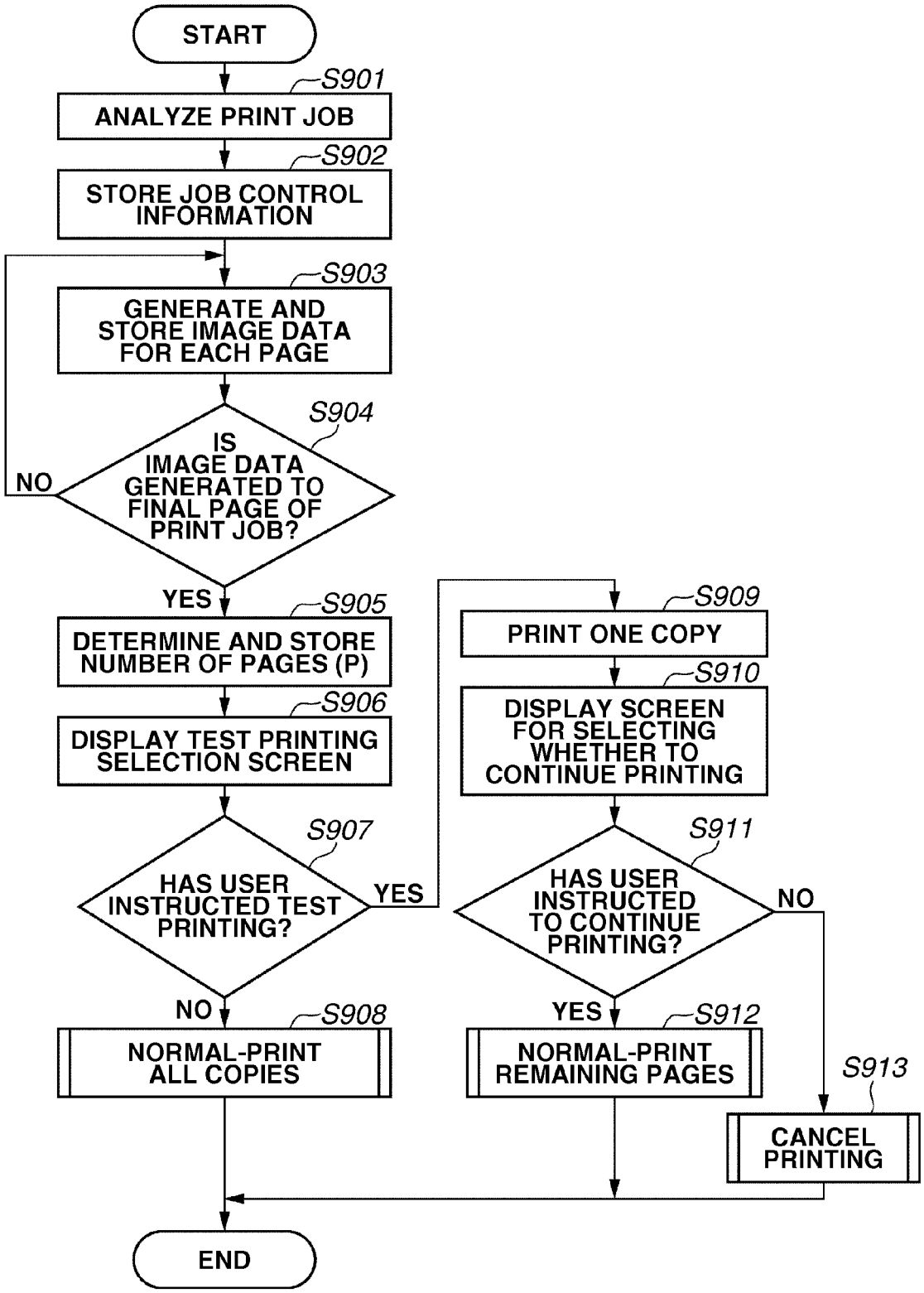
FIG. 9 is a flowchart illustrating a control method of the printing apparatus.

FIG. 9 is a flowchart illustrating the control method of the printing apparatus according to the present exemplary embodiment, i.e., an example in which the printing apparatus performs test printing using the grouped sheet feeding devices. Each step is realized by the CPU 305 loading in the RAM 306 and executing the control programs stored in the ROM 310 and the HDD 311.

In step S901, upon receiving the print job via the network, the CPU 305 controls the job controlling unit 325 and analyzes the received print job. The CPU 305 thus acquires the control information such as the number of copies (N), the sheet feed designation, and the sheet discharge processing information (e.g., stapling and discharging destination). In step S902, the CPU 305 stores in the job control information storing unit 326 the acquired information.

In step S903, the CPU 305 generates using the RIP 321 and stores in the RAM 305 the rasterized image data for each page to be printed. In step S904, the CPU 305 determines, based on a notification from the job control unit 325, whether the rasterized image data has been generated to the final page. If the rasterized image data has been generated to the final page (YES in step S903), the process proceeds to step S905. In step S905, the CPU 305 determines the number of printed pages (P) for each copy of the print job, and stores the information in the job control information storing unit 326.

In step S906, the CPU 305 instructs the operation unit 104 via the operation unit I/F 307 to display the screen (illustrated in FIG. 7) for inquiring the user whether to start test printing. In step S907, the CPU 305 determines whether the user has instructed to start test printing on the screen illustrated in FIG. 7.

If the user has not instructed to start test printing (NO in step S907), the process proceeds to step S908. In step S908, the CPU 305 performs normal printing and prints all copies, based on the rasterized image data stored in the RAM 306 and the information stored in the job control information storing unit 326. The process then ends. On the other hand, if the user has instructed to start test printing (YES in step S907), the process proceeds to step S909. In step S909, the CPU 305 prints only one copy based on the rasterized image data stored in the RAM 306.

In step S910, the CPU 305 instructs the operation unit 104 via the operation unit I/F 307 to display the screen (illustrated in FIG. 8) for inquiring the user on whether to continue printing the set N−1 copies. In step S911, if the user has instructed to continue printing (YES in step S911), the process proceeds to step S912. In step S912, the CPU 305 normally prints the set number of copies based on the rasterized image data stored in the RAM 306. The process then ends. The above-described set number of copies in step S912 is N−1 copies, which is stored as page number information in the job control information storing unit 326.

According to the present exemplary embodiment, after the CPU 305 interrupts printing by test printing one copy, the CPU 305 receives the instruction to continue printing the remaining number of copies. In other words, the CPU 305 performs a process for receiving an instruction to continue printing the copies. On the other hand, if the CPU 305 determines that the user has not instructed to continue printing (NO in step S911), the process proceeds to step S913. In step S913, the CPU 305 executes a predetermined process such as print cancel, and the process ends.

As a result, if printing of a plurality of copies is designated in the print job, one copy is printed by performing test printing. More specifically, one copy is printed according to the print job using the sheets contained in a plurality of sheet storage units belonging to the same group. The printed copy is then discharged, and the printing process is interrupted. The user thus confirms the result of test-printing one copy.

First Test Printing

Figure 10:
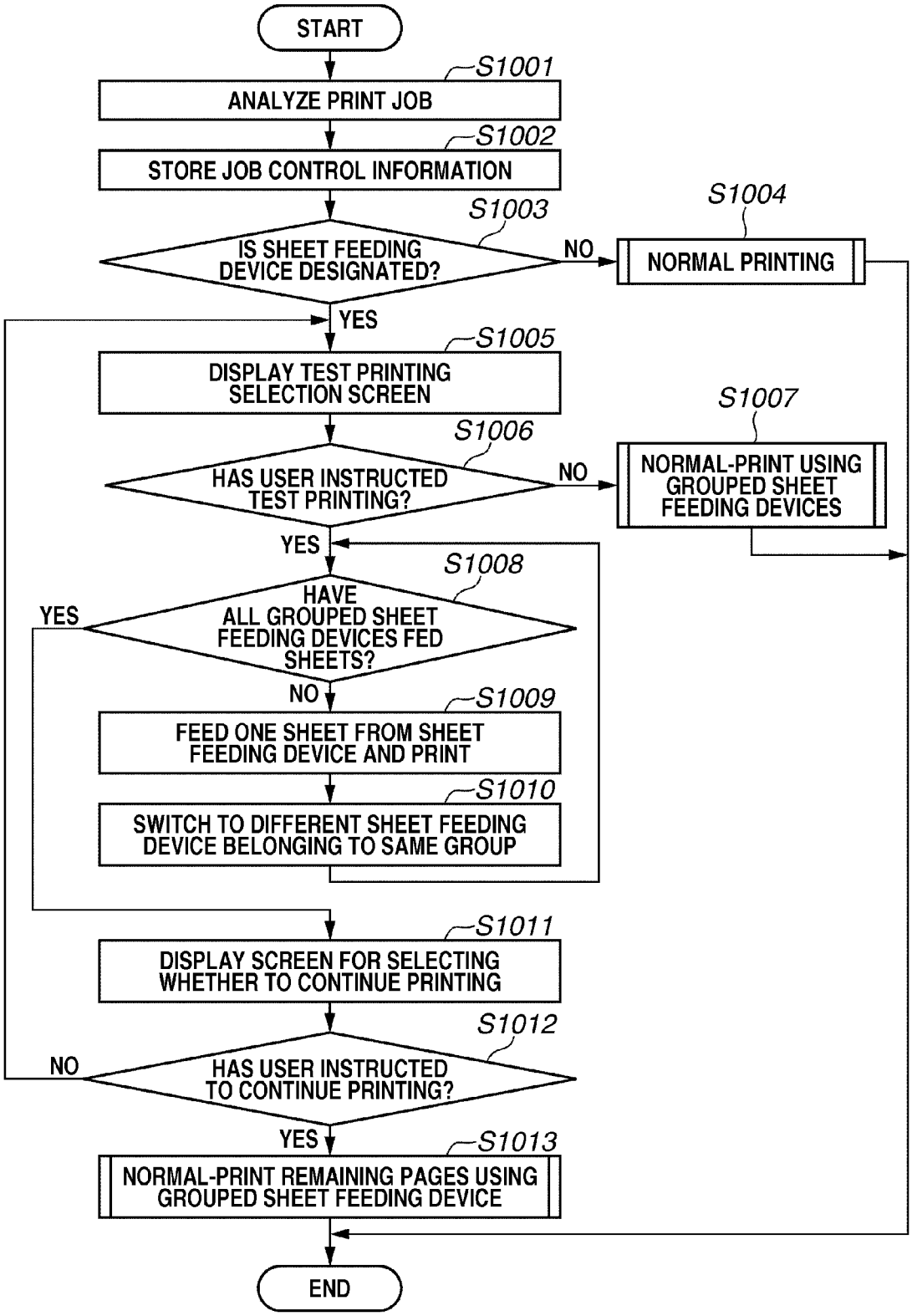
FIG. 10 is a flowchart illustrating a control method of the printing apparatus.

A first test printing process will be described below with reference to FIGS. 6, 7, 8, and 10. FIG. 10 is a flowchart illustrating the control method of the printing apparatus according to the present exemplary embodiment, i.e., an example of the first test printing process. Each step is realized by the CPU 305 loading in the RAM 306 and executing the control programs stored in the ROM 310 and the HDD 311. A one-copy test printing process will be described below. More specifically, if the received print job designates a plurality of sheet storage units as a usable group, each grouped sheet feeding device feeds one sheet so that the image data generated by the print job is printed on the sheets. The CPU 305 then discharges the sheets and temporarily interrupts printing.

In step S1001, upon receiving the print job via the network, the CPU 305 controls the job controlling unit 325 and analyzes the received print job. The CPU 305 thus acquires the control information such as the number of copies (N), the sheet feed designation, and the sheet discharge processing information (e.g., stapling and discharging destination). In step S1002, the CPU 305 stores in the job control information storing unit 326 the acquired information.

In step S1003, the CPU 305 determines whether the sheet feeding device is designated in the print job. If the sheet feeding device is not designated in the print job (NO in step S1003), the process proceeds to step S1004. In step S1004, the CPU 305 performs normal printing, and the process ends. The description on the normal printing process will be omitted.

On the other hand, if the sheet feeding device is designated in the print job (YES in step S1003), the process proceeds to step S1005. In step S1005, the CPU 305 instructs the operation unit 104 via the operation unit I/F 307 to display the screen (illustrated in FIG. 7) for inquiring the user on whether to perform test printing. In step S1006, the CPU 305 determines whether the user has selected performing test printing on the screen.

If the user has not selected performing test printing (NO in step S1006), the process proceeds to step S1007. In step S1007, the CPU 305 performs normal printing using the grouped sheet feeding device, and the process ends. The description on the normal printing process will be omitted.

If the user has selected performing test printing (YES in step S1006), the process proceeds to step S1008. In step S1008, the CPU 305 determines whether one sheet has been fed from each of the other sheet feeding devices belonging to the same group, based on the control information in the grouped sheet feeding device information table (illustrated in FIG. 5). If there is a sheet feeding device belonging to the same group which has not fed the sheet (NO in step S1008), the process proceeds to step S1009. In step S1009, the CPU 305 causes the currently designated sheet feeding device to feed one sheet and performs printing.

In step S1010, the CPU 305 switches a sheet feeding source to a sheet feeding device belonging to the same group other than the sheet feeding device used in step S1009. The CPU 305 switches the sheet feeding source based on the sheet feeding control unit 327 and the control information in the grouped sheet feeding device information table (illustrated in FIG. 5). The process then returns to step S1008. As a result, if one of the sheet feeding devices runs out of the sheets while continuously performing printing, the sheet feeding source is switched. More specifically, the sheet feeding source is automatically switched to feed the sheets from the other sheet feeding devices, i.e., a sheet feeding source switching process is performed.

In step S1008, if all sheet feeding devices belonging to the same group have each fed one sheet (YES in step S1008), the process proceeds to step S1011.

In step S1011, the CPU 305 temporarily stops printing, and instructs the operation unit 104 via the operation unit I/F 307 to display the screen (illustrated in FIG. 8) for the user to select whether to normally print the remaining pages. In step S1012, the CPU 305 determines whether the user has selected to continue to print (i.e., normally print) the remaining pages.

If the user has selected to continue to print (i.e., normally print) the remaining pages (YES in step S1012), the process proceeds to step S1013. In step S1013, the CPU 305 normally prints on the sheets fed from the grouped sheet feeding device, and the process ends. As a result, the printing apparatus is capable of continuing printing a number of sheets designated in the print job by subtracting the number of sheets printed in performing test printing. The printing result is thus not wasted.

If the user has not selected to continue printing (NO in step S1012), the process returns to step S1005. As described above, if the CPU 305 receives from the user the instruction to continue the interrupted printing process, the CPU 305 continues the interrupted printing process with respect to the print job. According to the present exemplary embodiment, if the user instructs re-performing test printing, the process returns to step S1010. However, the predetermined processes such as print cancelling may be performed, and the print job may end.

As described above, when the print job in which a grouped sheet feeding device is designated is input to the printing apparatus, the printing apparatus performs test printing by sequentially feeding one sheet from each of the grouped sheet feeding devices. The user can thus acquire the results and determine whether the sheets contained in the sheet feeding devices are the desired sheets. Error printing on a wrong sheet contained in the grouped sheet feeding device can thus be prevented. Further, the user can select whether to perform test printing to confirm the sheets.

Second Test Printing

A second test printing process will be described below with reference to FIGS. 5, 7, 8, 11, 12, and 13.

Figure 11:
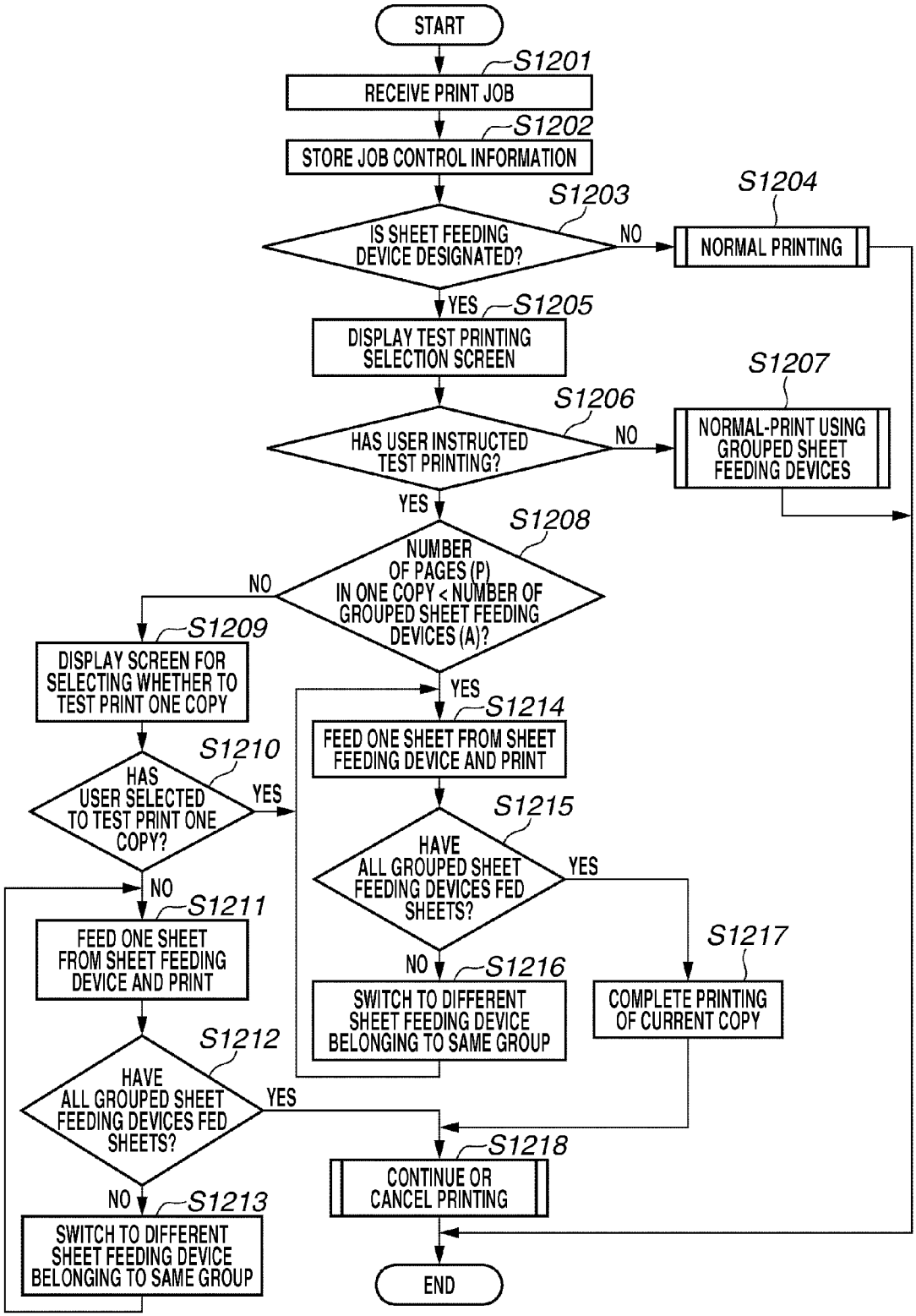
FIG. 11 is a flowchart illustrating a control method of the printing apparatus.

FIG. 11 is a flowchart illustrating the control method of the printing apparatus according to the present exemplary embodiment, i.e., the second test printing process. Each step in the flowchart is realized by the CPU 305 loading the control programs from ROM 310 and the HDD 311 to the RAM 306 and executing them.

Figure 12:
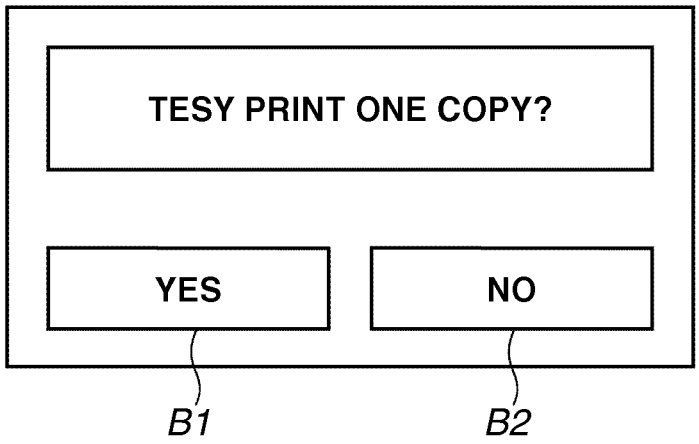
FIG. 12 illustrates an example of the UI displayed on the operation unit illustrated in FIG. 3.

FIG. 12 illustrates an example of the UI displayed on the operation unit 104 illustrated in FIG. 3, i.e., an example of the screen for inquiring the user on test-printing one copy.

In step S1201, upon receiving the print job from the information processing apparatus via the network, the CPU 305 controls the job controlling unit 325 and analyzes the received print job. The CPU 305 thus acquires the control information such as the number of copies (N), the sheet feed designation, and the sheet discharge processing information (e.g., stapling and discharging destination). In step S1202, the CPU 305 stores the acquired information in the job control information storing unit 326.

In step S1203, the CPU 305 determines whether the sheet feeding device is designated in the print job. If the sheet feeding device is designated in the print job (YES in step S1203), the process proceeds to step S1204. In step S1204, the CPU 305 performs normal printing, and the process ends. The description on the normal printing process will be omitted.

On the other hand, if the sheet feeding device is designated in the print job (YES in step S1203), the process proceeds to step S1205. In step S1205, the CPU 305 instructs the operation unit 104 via the operation unit I/F 307 to display the screen (illustrated in FIG. 7) for inquiring the user on whether to perform test printing. In step S1206, the CPU 305 determines whether the user has selected performing test printing on the screen. If the user has not selected performing test printing (NO in step S1206), the process proceeds to step S1207. In step S1207, the CPU 305 performs normal printing using the grouped sheet feeding device, and the process ends.

If the CPU 305 determines that the user has selected performing test printing (YES in step S1206) in the UI screen displayed on the operation unit 104, the process proceeds to step S1208. In step S1208, the CPU 305 acquires from the grouped sheet feeding device information table (illustrated in FIG. 5) stored in the sheet feeding/discharging control information storing unit 329, the number of grouped sheet feeding devices (A) belonging to the same group. The CPU 305 then compares the acquired number of grouped sheet feeding devices (A) belonging to the same group with the number of pages (P) to be printed for each copy of the received print job. More specifically, the CPU 305 determines whether the number of pages (P) to be printed for each copy of the print job is less than the number of sheet feeding devices (A).

If the number of pages to be printed (P) is less than the number of sheet feeding devices (A) (YES in step S1208), the process proceeds to step S1214. In step S1214, the CPU 305 causes the currently designated sheet feeding device to feed one sheet and performs printing.

In step S1215, the CPU 305 determines whether one sheet has been fed from each of the other sheet feeding devices belonging to the same group, based on the control information in the grouped sheet feeding device information table (illustrated in FIG. 5). If there is a sheet feeding device belonging to the same group which has not yet fed the sheet (NO in step S1215), the process proceeds to step S1216. In step S1216, the CPU 305 switches the sheet feeding source to another sheet feeding device belonging to the same group which has not yet fed the sheet. The CPU 305 switches the sheet feeding source based on the control information in the grouped sheet feeding device information table (illustrated in FIG. 5). The process then returns to step S1214.

If all sheet feeding devices belonging to the same group has fed the sheet (YES in step S1215), the process proceeds to step S1217. In step S1217, the CPU 305 normally prints to the last page of the copy which is currently being printed. In such a case, the sheet feeding device is not switched. In step S1218, the CPU 305 continues printing or cancels printing, and the process ends.

If the number of pages to be printed (P) is greater than the number of sheet feeding devices (A) (NO in step S1208), the process proceeds to step S1209. In step S1209, the CPU 305 instructs the operation unit 104 via the operation unit I/F 307 to display a screen (illustrated in FIG. 12) for the user to select whether to perform test printing only on the number of sheets corresponding to the number (A) of grouped sheet feeding devices, or test print one copy.

In step S1210, the CPU 305 determines whether the user has selected a button for test printing one copy. If the user has selected the button for test-printing one copy (YES in step S1210), the process proceeds to step S1214.

On the other hand, if the user has not selected a button B1 for test-printing one copy, and has selected a button B2 (NO in step S1210), the process proceeds to step S1211. In step S1211, the CPU 305 causes the currently designated sheet feeding device to feed one sheet and performs printing. In step S1212, the CPU 305 controls the sheet feeding control unit 327 based on the control information in the control information in the grouped sheet feeding device information table (illustrated in FIG. 5), and determines whether one sheet has been fed from each of the other sheet feeding devices belonging to the same group.

If there is a sheet feeding devices belonging to the same group which has not yet fed the sheet (NO in step S1212), the process proceeds to step S1213. In step S1213, the CPU 305 switches the sheet feeding source to a sheet feeding device belonging to the same group which has not yet fed the sheet, based on the control information in the grouped sheet feeding device information table (illustrated in FIG. 5). The process then returns to step S1211. If all sheet feeding devices belonging to the same group have fed the sheet (YES in step S1212), the process proceeds to step S1218. In step S1218, the CPU 305 continues printing or stops printing, and the process ends.

Figure 13:
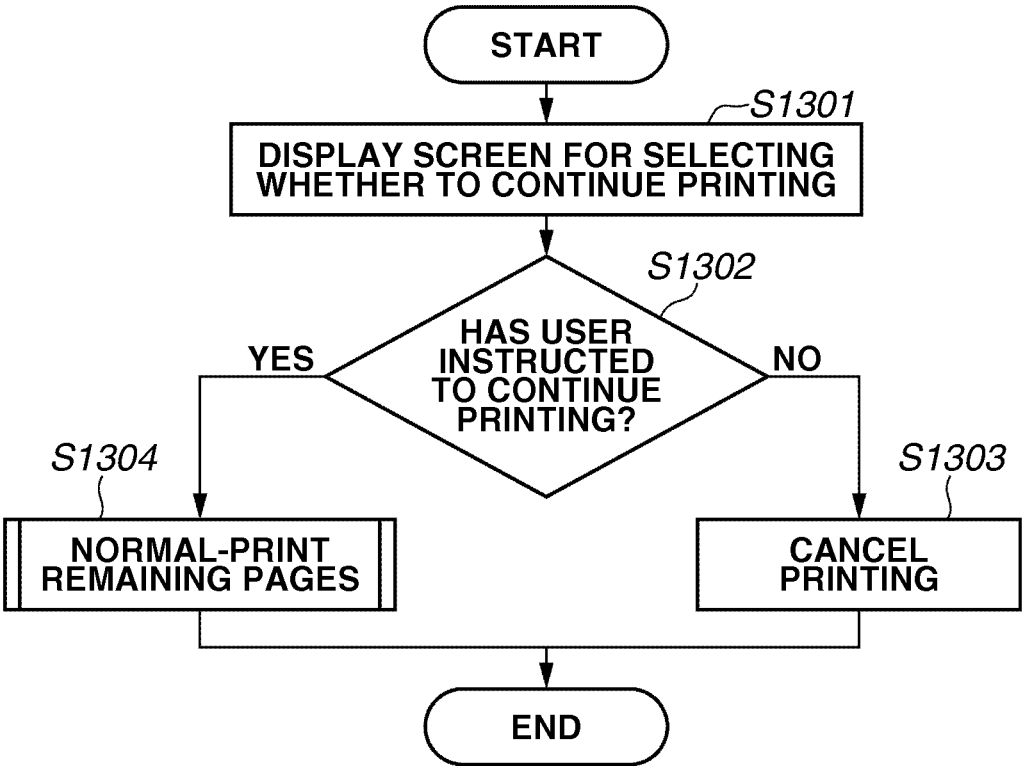
FIG. 13 is a flowchart illustrating a control method of the printing apparatus.

FIG. 13 is a flowchart illustrating the control method of the printing apparatus according to the present exemplary embodiment, i.e., a detailed procedure for continuing or cancelling printing performed in step S1218 of the second test printing process illustrated in FIG. 12. Each step in the flowchart is realized by the CPU 305 loading the control programs from ROM 310 and the HDD 311 to the RAM 306 and executing them.

In step S1301, the CPU 305 displays on the operation unit 104 via the operation unit I/F 307, the screen (illustrated in FIG. 8) for the user to select whether to normally print the remaining pages. In step S1302, the CPU 305 determines whether the user has instructed to continue to print (i.e., normally print) the remaining pages.

If the user has instructed to continue to print (i.e., normally print) the remaining pages (YES in step S1302), the process proceeds to step S1304. In step S1304, the CPU 305 prints using the job control unit 325 and the job control information storing unit 326, the number of copies of the rasterized image data stored in the RAM 306, and the process ends. The number of copies corresponds to the difference between the number of copies N stored in the job control information storing unit 326 and the number of copies printed in step S1217 illustrated in FIG. 11. The printing process performed by the CPU 305 at this time is a normal printing process from the grouped feeding devices.

If the CPU 305 determines that the user has not instructed to continue printing (NO in step S1302), the process proceeds to step S1303. In step S1303, the CPU 305 cancels printing, and the process ends.

As described above, according to the present exemplary embodiment, the number of copies to be printed in performing test printing can be changed, based on a relation between the number of pages for each copy in the print job and the number of the grouped sheet feeding devices. As a result, printing can always be performed on the sheets fed from all grouped sheet feeding devices regardless of the number of pages for each copy, so that a failure in confirming the sheets can be prevented.

A second exemplary embodiment will be described below with reference to FIGS. 6, 7, 8, 12, 13, 14, 15, 16, 17, and 18.

Figure 14:
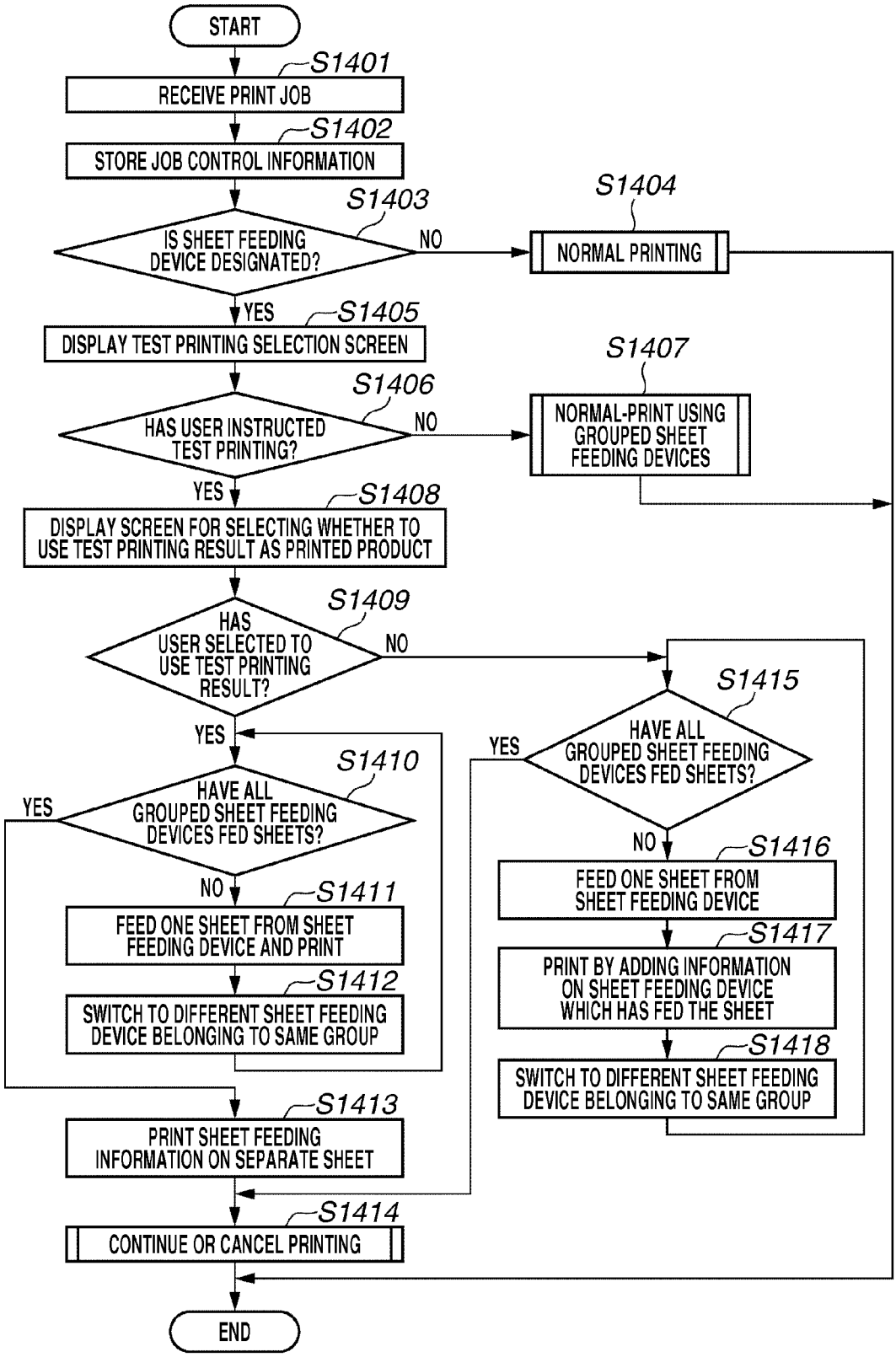
FIG. 14 is a flowchart illustrating a control method of the printing apparatus.

FIG. 14 is a flowchart illustrating the control method of the printing apparatus according to the present exemplary embodiment, i.e., a detailed procedure of the test printing process. Each step in the flowchart is realized by the CPU 305 loading the control programs from ROM 310 and the HDD 311 to the RAM 306 and executing them.

Figure 15:
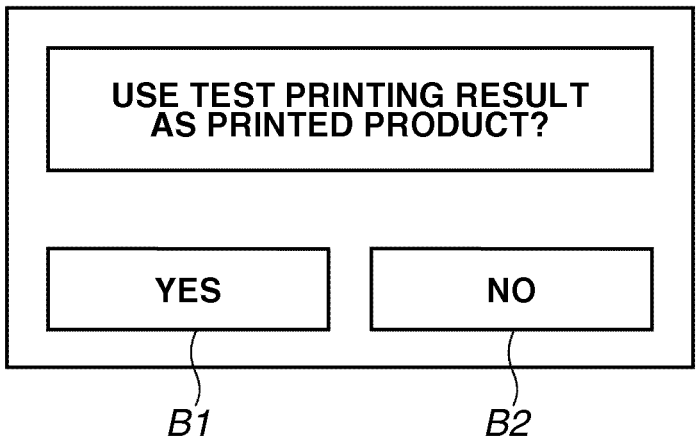
FIG. 15 illustrates an example of the UI displayed on the operation unit illustrated in FIG. 3.

FIG. 15 illustrates an example of the UI displayed in the operation unit 104 illustrated in FIG. 3, i.e., a screen for inquiring the user on whether to perform test printing in which the result will be actually used as a printed product.

In step S1401, upon receiving the print job from the information processing apparatus via the network, the CPU 305 controls the job controlling unit 325 and analyzes the received print job. The CPU 305 thus acquires the control information such as the number of copies (N), the sheet feed designation, and the sheet discharge processing information (e.g., stapling and discharging destination). In step S1402, the CPU 305 stores in the job control information storing unit 326 the acquired information.

In step S1403, the CPU 305 determines whether the sheet feeding device is designated in the print job. If the sheet feeding device is not designated in the print job (NO in step S1403), the process proceeds to step S1404. In step S1404, the CPU 305 performs normal printing, and the process ends. The description on the normal printing process will be omitted.

On the other hand, if the sheet feeding device is designated in the print job (YES in step S1403), the process proceeds to step S1405. In step S1405, the CPU 305 instructs the operation unit 104 via the operation unit I/F 307 to display the screen (illustrated in FIG. 7) for inquiring the user on whether to perform test printing. In step S1406, the CPU 305 determines whether the user has selected the button B1 for performing test printing.

If the user has not selected the button B1 for performing test printing (NO in step S1406), the process proceeds to step S1407. In step S1407, the CPU 305 performs normal printing using the grouped sheet feeding device, and the process ends.

If the user has selected the button B1 for performing test printing (YES in step S1406), the process proceeds to step S1408. In step S1408, the CPU 305 causes the operation unit 104 via the operation unit I/F 307 to display a screen (illustrated in FIG. 15) for the user to select whether the test printing result is to be used as the printed product.

In step S1409, the CPU 305 determines whether the user has selected the button B1 for instructing to perform test printing in which the result is to be used as the printed product. If the user has not instructed to perform test printing in which the result is to be used as the printed product (NO in step S1409), the process proceeds to step S1415. In step S1415, the CPU 305 controls the sheet feeding control unit 327 and determines whether one sheet has been fed from each of the other sheet feeding devices belonging to the same group, based on the control information in the grouped sheet feeding device information table (illustrated in FIG. 5).

If there is sheet feeding devices belonging to the same group which has not fed the sheet (NO in step S1415), the process proceeds to step S1416. In step S1416, the CPU 305 causes the currently designated sheet feeding device to feed one sheet. In step S1417, the CPU 305 controls the sheet feeding control unit 327 and acquires from a sheet feeding device information table illustrated in FIG. 16, information on the sheet feeding device which has actually fed the sheet in step S1416. The CPU 305 then prints the acquired information on a portion of the fed sheet, along with the rasterized print image data stored in the RAM 306. The information on the sheet feeding device includes a sheet feeding device number.

Figure 17:
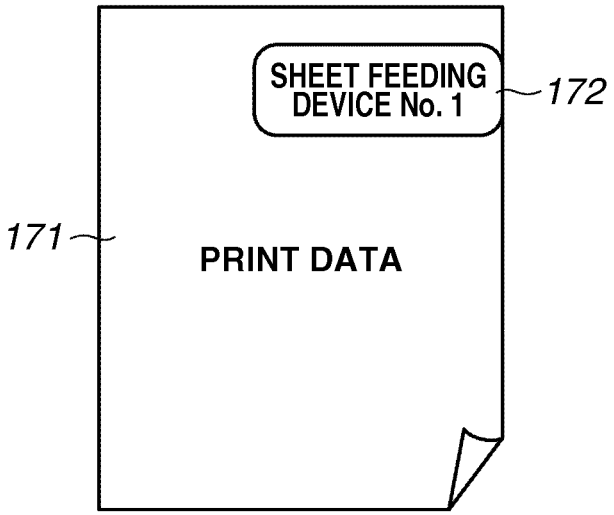
FIG. 17 illustrates an example of an output result of the printing apparatus.

FIG. 17 illustrates an example of the output result of the printing apparatus according to the present exemplary embodiment. Referring to FIG. 17, the printer 323 illustrated in FIG. 3 outputs the sheet feeding device information on an upper right corner of the sheet, along with the print data. In particular, the example of FIG. 17 illustrates the output result in the case where the sheet has been fed from a sheet feeding device No. 1.

In FIG. 17, sheet feeding device information 172 is printed on a fed sheet 171. The output example of the sheet feeding device information 172 is not limited to the example according to the present exemplary embodiment, and an output position may be designated by the user, or a character size may be changeable.

In step S1418, the CPU 305 controls the sheet feeding control unit 327 and switches the sheet feeding source to a sheet feeding devices belonging to the same group which has not yet fed the sheets. The CPU 305 switches the sheet feeding source based on the control information in the grouped sheet feeding device information table (illustrated in FIG. 5). The process then returns to step S1415.

If all sheet feeding devices belonging to the same group have fed the sheet (YES in step S1415), the process proceeds to step S1414. In step S1414, the CPU 305 continues or cancels printing. The process for continuing or cancelling printing is the same as the flow illustrated in FIG. 13, so that description will be omitted.

If the user has instructed performing test printing in which the result is to be used as the printed product (YES in step S1409), the process proceeds to step S1410. In step S1410, the CPU 305 controls the sheet feeding control unit 327 and determines whether one sheet has been fed from each of the other sheet feeding devices belonging to the same group, based on the control information in the grouped sheet feeding device information table (illustrated in FIG. 5). If there is a sheet feeding device belonging to the same group which has not fed the sheet (NO in step S1410), the process proceeds to step S1411. In step S1411, the CPU 305 causes the currently designated sheet feeding device to feed one sheet and performs printing.

In step S1412, the CPU 305 controls the sheet feeding control unit 327 and switches the sheet feeding source to a sheet feeding devices belonging to the same group which has not yet fed the sheets. The CPU 305 switches the sheet feeding source based on the control information in the grouped sheet feeding device information table (illustrated in FIG. 5). The process then returns to step S1410. If the CPU 305 determines that all sheet feeding devices belonging to the same group have fed the sheet (YES in step S1410), the process proceeds to step S1413.

Figure 18:
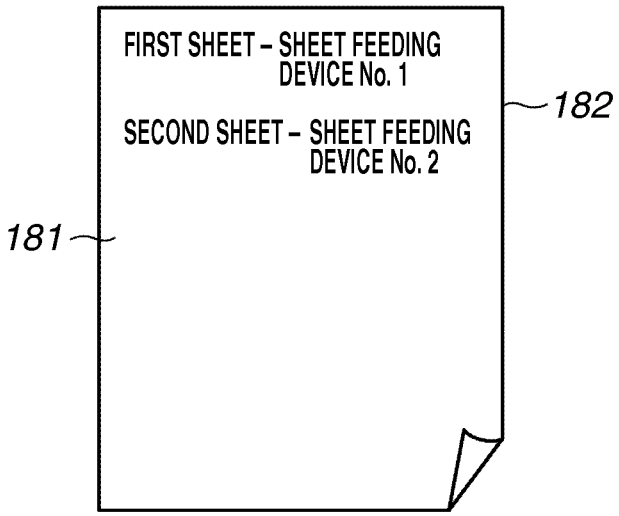
FIG. 18 illustrates an example of the output result of the printing apparatus.

In step S1413, the CPU 305 controls the sheet feeding control unit 327, and acquires from the sheet feeding device information table (illustrated in FIG. 16), the information (e.g., the sheet feeding device number) on the sheet feeding device which has actually fed the sheet in step S1411. The CPU 305 prints the acquired sheet feeding device information on the fed sheet as illustrated in FIG. 18 for each actually fed sheet. In such a case, the CPU 305 prints the sheet feeding device information separately from the sheet the rasterized image data stored in the RAM 306 is to be printed. In step S1414, the CPU 305 continues or cancels printing, and the process ends. The process for continuing or cancelling printing is the same as the flow illustrated in FIG. 13, so that description will be omitted.

FIG. 18 illustrates an example of the output result of the printing apparatus according to the present exemplary embodiment. The example illustrates the output result from the printer 323 on the information indicating that the first sheet has been output from the sheet feeding device No. 1, and the second sheet has been output from the sheet feeding device No. 2. Referring to FIG. 18, the sheet feeding device information which is different from the print data is printed on a sheet 182. The information on the sheet feeding device used for feeding each sheet is printed on the sheet 182.

As described above, the information on the sheet feeding device which has fed the sheet is printed on each test-printed sheet, so that the user can easily confirm the sheet feeding device from which the sheet has been fed. Further, the information on the sheet feeding device which has fed the sheet in performing test printing is printed on a separate sheet from a sheet of the print data, so that the printing result can be re-used as the printed product.

A third exemplary embodiment will be described below with reference to FIGS. 5, 7, and 19.

Figure 19:
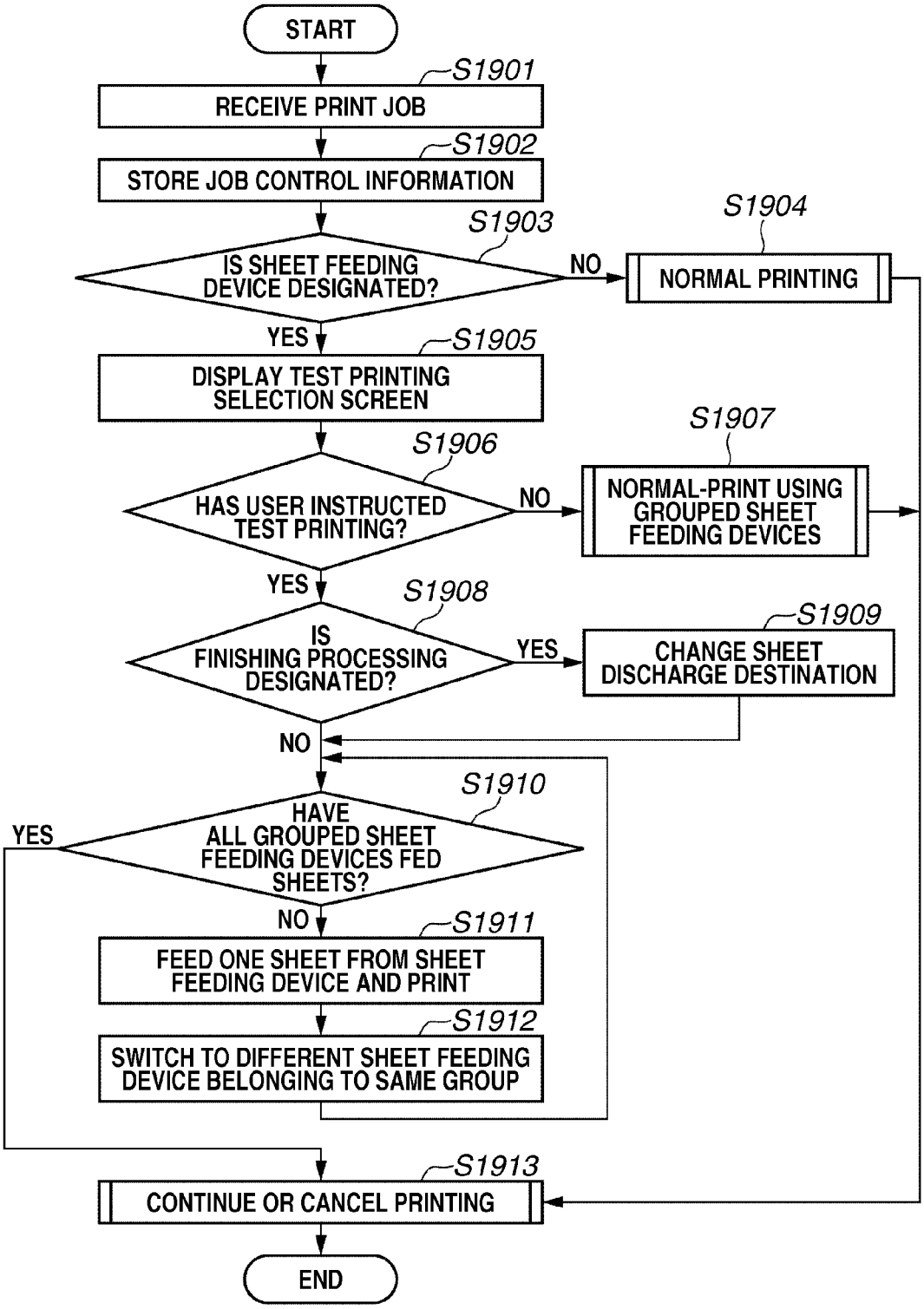
FIG. 19 is a flowchart illustrating a control method of the printing apparatus.

FIG. 19 is a flowchart illustrating the control method of the printing apparatus according to the present exemplary embodiment, i.e., a detailed procedure of the test printing process. Each step in the flowchart is realized by the CPU 305 loading the control programs from ROM 310 and the HDD 311 to the RAM 306 and executing them.

In step S1901, upon receiving the print job from the information processing apparatus via the network, the CPU 305 controls the job controlling unit 325 and analyzes the received print job. The CPU 305 thus acquires the control information such as the number of copies (N), the sheet feed designation, and the sheet discharge processing information (e.g., stapling and discharging destination). In step S1902, the CPU 305 stores the acquired information in the job control information storing unit 326.

In step S1903, the CPU 305 determines whether the sheet feeding device is designated in the print job. If the sheet feeding device is not designated in the print job (NO in step S1903), the process proceeds to step S1904. In step S1904, the CPU 305 performs normal printing, and the process ends. The description on the normal printing process will be omitted.

On the other hand, if the sheet feeding device is designated in the print job (YES in step S1903), the process proceeds to step S1905. In step S1905, the CPU 305 instructs the operation unit 104 via the operation unit I/F 307 to display the screen (illustrated in FIG. 7) for the user to select whether to perform test printing. In step S1906, the CPU 305 determines whether the user has selected the button B1 for performing test printing. If the user has not selected the button B1 for performing test printing (NO in step S1906), the process proceeds to step S1907. In step S1907, the CPU 305 performs normal-printing using grouped sheet feeding devices. On the other hand, if the user has selected the button B1 for performing test printing (YES in step S1906), the process proceeds to step S1908. In step S1908, the CPU 305 determines whether a finishing processing (e.g., stapling) is designated, based on the control information stored in the job control information storing unit 326.

If the finishing processing is designated (YES in step S1908), the process proceeds to step S1909. In step S1909, the CPU 305 controls the sheet discharging control unit 328 and switches the sheet discharge destination to a discharge destination (e.g., a tray 1201) in which the sheet is not discharged outside the printing apparatus. The process then proceeds to step S1910.

If the finishing processing is not designated (NO in step S1908), the process proceeds to step S1910. In step S1910, the CPU 305 controls the sheet feeding control unit 327 and determines whether one sheet has been fed from each sheet feeding device belonging to the same group, based on the control information in the grouped sheet feeding device information table (illustrated in FIG. 5). If there is a sheet feeding device belonging to the same group which has not fed the sheet (NO in step S1910), the process proceeds to step S1911. In step S1911, the CPU 305 causes the currently designated sheet feeding device to feed one sheet and performs printing.

In step S1912, the CPU 305 controls the sheet feeding control unit 327 and switches the sheet feeding source to a sheet feeding devices belonging to the same group which has not yet fed the sheets, based on the control information in the grouped sheet feeding device information table (illustrated in FIG. 5). The process then returns to step S1910. If all sheet feeding devices belonging to the same group have fed the sheet (YES in step S1910), the process proceeds to step S1913. In step S1913, the CPU 305 continues or cancels printing, and the process ends. Since the process for continuing or cancelling printing is the same as the process described in FIG. 13, description will be omitted.

As described above, according to the present exemplary embodiment, the printing apparatus uses a finishing setting of the print job and determines whether the test printing result can be used as the printed product. The printing apparatus is thus capable of automatically changing the discharge destination, and it becomes unnecessary for the user to sort the print results.

According to the above-described exemplary embodiments, test printing can be performed, i.e., one sheet is sequentially fed from each of the grouped sheet feeding devices and printed. As a result, the user can confirm the test printing result and determine whether the desired sheet is contained in all grouped sheet feeding devices. Further, according to the above-described exemplary embodiments, it is not necessary to use special hardware such as the sensor for detecting the information on the sheet (e.g., size and color), so that control can be easily performed at low cost to prevent printing on the wrong sheet.

OTHER EMBODIMENTS

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-190737 filed Sep. 1, 2011, which is hereby incorporated by reference herein in its entirety.

What is claimed is:

1. A printing system which conveys a sheet from one of a plurality of sheet storage units and prints an image on a conveyed sheet, the printing system comprising:

a setting unit configured to set two or more sheet storage units among a plurality of sheet storage units as one group;

a printing unit configured to convey one sheet from each of the two or more sheet storage units set as one group, print an image on the conveyed sheets, discharge the sheets to a sheet discharge unit, and interrupt printing;

a receiving unit configured to receive an instruction to continue the interrupted printing; and a control unit configured to perform, in a case where the receiving unit receives the instruction, control to resume the interrupted printing.

2. The printing system according to claim 1, wherein the printing unit prints, in a case where printing of a plurality of copies is instructed, one copy among the plurality of copies, and interrupts printing, and wherein the control unit performs, in a case where the receiving unit receives the instruction, control to resume the interrupted printing to print the remaining copies.

3. The printing system according to claim 1, wherein the control unit performs control to resume the interrupted printing of images on sheets of a subtracted number which is a difference between a total number of sheets to be printed and the number of sheets the printing unit has printed.

4. The printing system according to claim 1, further comprising a changing unit configured to change, in a case where one of the two or more sheet storage units has run out of sheets after resuming printing, a sheet feeding source to feed sheets from other sheet storage units.

5. A printing system according to claim 1, wherein the printing unit conveys, according to a request from a user, one sheet from each of the two or more sheet storage units set as one group by the setting unit, prints an image on the conveyed sheets, discharges the sheets to a sheet discharge unit, and interrupts printing.

6. A control method for controlling a printing system which conveys a sheet from one of a plurality of sheet storage units and prints an image on a conveyed sheet, the control method comprising:

setting two or more sheet storage units among a plurality of sheet storage units as one group;

conveying one sheet from each of the two or more sheet storage units set as one group, printing an image on the conveyed sheets, discharging the sheets to a sheet discharge unit, and interrupting printing;

receiving an instruction to continue the interrupted printing; and performing, in a case where the instruction is received, control to resume the interrupted printing.

7. A non-transitory computer-readable storage medium storing a computer program for causing a computer to execute the control method according to claim 6.

* * * * *